US007070241B2

(12) United States Patent
Saulnier et al.

(10) Patent No.: US 7,070,241 B2
(45) Date of Patent: Jul. 4, 2006

(54) ERGONOMIC SEATING ASSEMBLY

(75) Inventors: Caroline Saulnier, 880 Albert-Beaulieu, App. 202, Joliette, Québec (CA) J6E 3Z1; Nicola Tardif-Bourdages, Montréal (CA); Dominic Thériault, Saint-Jacques (CA)

(73) Assignee: Caroline Saulnier, Joliette (CA)

( * ) Notice: Subject to any disclaimer, the term of this patent is extended or adjusted under 35 U.S.C. 154(b) by 0 days.

(21) Appl. No.: 10/976,870

(22) Filed: Nov. 1, 2004

(65) Prior Publication Data

US 2005/0225150 A1 Oct. 13, 2005

Related U.S. Application Data

(60) Provisional application No. 60/560,040, filed on Apr. 8, 2004.

(51) Int. Cl.
*A47C 7/50* (2006.01)

(52) U.S. Cl. ..... 297/423.12; 297/423.11

(58) Field of Classification Search ..... 297/423.11, 297/423.1, 423.12, 423.16
See application file for complete search history.

(56) References Cited

U.S. PATENT DOCUMENTS

| | | | | | |
|---|---|---|---|---|---|
| 3,025,526 | A | | 3/1962 | Ramon | |
| 3,820,844 | A | * | 6/1974 | Fortnam | 297/423.37 |
| 4,328,991 | A | | 5/1982 | Mengshoel et al. | |
| 4,377,309 | A | | 3/1983 | Mengshoel | |
| 4,534,590 | A | * | 8/1985 | Yamamura et al. | 297/180.12 |
| 4,589,699 | A | | 5/1986 | Dungan | |
| 4,650,249 | A | | 3/1987 | Serber | |
| D291,155 | S | * | 8/1987 | Wertheimer | D6/335 |
| 4,767,159 | A | * | 8/1988 | Opsvik | 297/423.11 |
| 4,772,071 | A | | 9/1988 | Richards | |
| D299,594 | S | * | 1/1989 | Richardson | D6/335 |
| 4,831,666 | A | | 5/1989 | Denman | |
| 4,832,407 | A | | 5/1989 | Serber | |
| 4,960,305 | A | * | 10/1990 | Opsvik | 297/423.12 |
| 5,054,857 | A | * | 10/1991 | Kvalheim | 297/423.13 |
| 5,186,519 | A | * | 2/1993 | Larson | 297/423.12 |
| 5,251,961 | A | * | 10/1993 | Pass | 297/423.1 |
| 5,255,957 | A | * | 10/1993 | Opsvik et al. | 297/423.12 |
| 5,330,254 | A | * | 7/1994 | Larson | 297/354.11 |
| 5,380,021 | A | | 1/1995 | Doherty | |
| 5,401,078 | A | * | 3/1995 | Riach | 297/423.11 |
| 5,577,800 | A | | 11/1996 | Earl, Jr. | |
| 5,865,507 | A | | 2/1999 | Earl, Jr. | |

(Continued)

FOREIGN PATENT DOCUMENTS

| | | |
|---|---|---|
| CA | 2383399 | 10/2002 |

(Continued)

*Primary Examiner*—Rodney B. White
*Assistant Examiner*—Stephen D'Adamo
(74) *Attorney, Agent, or Firm*—Ogilvy Renault, LLP

(57) ABSTRACT

The present invention relates to a multi-posture body support device adapted for working proximate to the floor. The device comprises: a frame extending at floor level, the frame having a front section, a rear section, and an extendible post in the rear section, the post being in a substantially perpendicular orientation relatively to the floor; an upper support adjustably mounted to the post; and a knee support mounted to the frame in front of the post and below the upper support, the knee support having a proximate end positioned proximate to the post and a distal end opposite to the proximate end; the knee support being substantially flat longitudinally between the proximate and distal ends for supporting longitudinally the legs of a worker facing one of the rear section and the front section relatively to the frame.

20 Claims, 5 Drawing Sheets

U.S. PATENT DOCUMENTS

| | | | | |
|---|---|---|---|---|
| 5,887,948 | A | 3/1999 | Hannes | |
| 5,983,418 | A * | 11/1999 | Goodman et al. | 4/571.1 |
| 6,089,667 | A | 7/2000 | Hobbs | |
| 6,302,413 | B1 * | 10/2001 | Comeaux | 297/423.11 X |
| 6,425,590 | B1 | 7/2002 | Whiteside et al. | |
| 6,595,590 | B1 * | 7/2003 | Bottoms | 297/423.11 |
| 6,619,747 | B1 | 9/2003 | Ko et al. | |
| 6,926,365 | B1 * | 8/2005 | Bottoms | 297/423.12 |
| 2002/0092098 | A1 | 7/2002 | Michalow | |
| 2002/0158492 | A1 | 10/2002 | Ko et al. | |
| 2003/0168899 | A1 * | 9/2003 | Voyce | 297/423.11 |

FOREIGN PATENT DOCUMENTS

| | | | | |
|---|---|---|---|---|
| DE | 3106975 | | 9/1982 | |
| DE | 3541120 | A1 * | 5/1987 | 297/423.12 |
| WO | WO 8800016 | A1 * | 1/1988 | 297/423.12 |
| WO | WO 03/000093 | | 1/2003 | |

* cited by examiner

ERGONOMIC SEATING ASSEMBLY

CROSS-REFERENCE TO RELATED APPLICATIONS

This application claims priority of U.S. provisional patent application Ser. No. 60/560,040, filed on Apr. 8, 2004 the specification of which is hereby incorporated by reference.

BACKGROUND OF THE INVENTION

1) Field of the Invention

The invention relates to body supports and, more particularly, to ergonomic seating assemblies allowing a plurality of postures.

2) Description of the Prior Art

Workers, such as mechanics, brick layers, tile setters, painters, and welders, are often required to perform their tasks from a seating or a kneeling positions proximate to the floor. Maintaining these positions as well as moving from one position to another typically places a great deal of strain on the worker. The worker must make several transition movements from kneeling to sitting to standing in a typical workday.

It is well known in the art to use seating assemblies for either one or a combination of supports to the torso, the buttocks, the knees, and the forearms to help a worker to have more comfort in a low working position.

Several working seats have been developped where a support for the chest area is present whilst the knees are either not supported as in a commonly used chair or wherein a shin support is present [See for instance U.S. Pat. No. 6,619,747 of Ko et al., U.S. Pat. No. 4,832,407 issued to Serber, U.S. Pat. No. 4,650,249 issued to Serber, and U.S. Pat. No. 5,887,948 issued to Hannes].

Other working seats provide for a kneeling apparatus of some type, but they only offer a single posture to the worker [See for instance U.S. Pat. No. 6,302,413 issued to Comeaux, U.S. Pat. No. 4,772,071 issued to Richards, U.S. Pat. No. 5,865,507 Issued to Earl, Jr., and International Publication No. 03/000093].

SUMMARY OF THE INVENTION

It is an object of the present invention to provide an improved ergonomic working seat when working in seating and kneeling positions, especially in low working positions.

One aspect of the invention provides a multi-posture seating assembly for a worker working proximate to the floor. The seating assembly comprises: a frame adapted to rest at floor level and having a forward end and a rearward end; an upper support adjustably mounted to the frame, proximate to the rearward end, the upper support being at least forwardly and rearwardly tiltable relative to the floor; and a knee support extending longitudinally along the frame, frontwardly to the upper supper and at a lower elevation than the upper support, the knee support being longitudinally substantially leveled for supporting the legs of the worker facing in one of the forward direction and the rearward direction relatively to the frame, the upper support and the knee support being configurable between a first configuration in which the upper support provides support to the torso of the worker facing rearwardly while the knees of the worker rest longitudinally on the knee support, and a second configuration in which the upper support is inclined relative to knee support to provide support to the buttocks of the worker facing frontwardly while the knees thereof rest longitudinally on the knee support.

Another aspect of the invention provides a multi-posture body support device adapted for working proximate to the floor. The body support device comprises: a frame extending at floor level, the frame having a front section, a rear section, and an extendible post in the rear section, the post being in a substantially perpendicular orientation relatively to the floor; an upper support adjustably mounted to the post; and a knee support mounted to the frame in front of the post and below the upper support, the knee support having a proximate end positioned proximate to the post and a distal end opposite to the proximate end; the knee support being substantially flat longitudinally between the proximate and distal ends for supporting longitudinally the legs of a worker facing one of the rear section and the front section relatively to the frame.

BRIEF DESCRIPTION OF THE DRAWINGS

Further features and advantages of the present invention will become apparent from the following detailed description, taken in combination with the appended drawings, in which.

It will be noted that throughout the appended drawings, like features are identified by like reference numerals.

DETAILED DESCRIPTION OF THE PREFERRED EMBODIMENT

Figure 1:
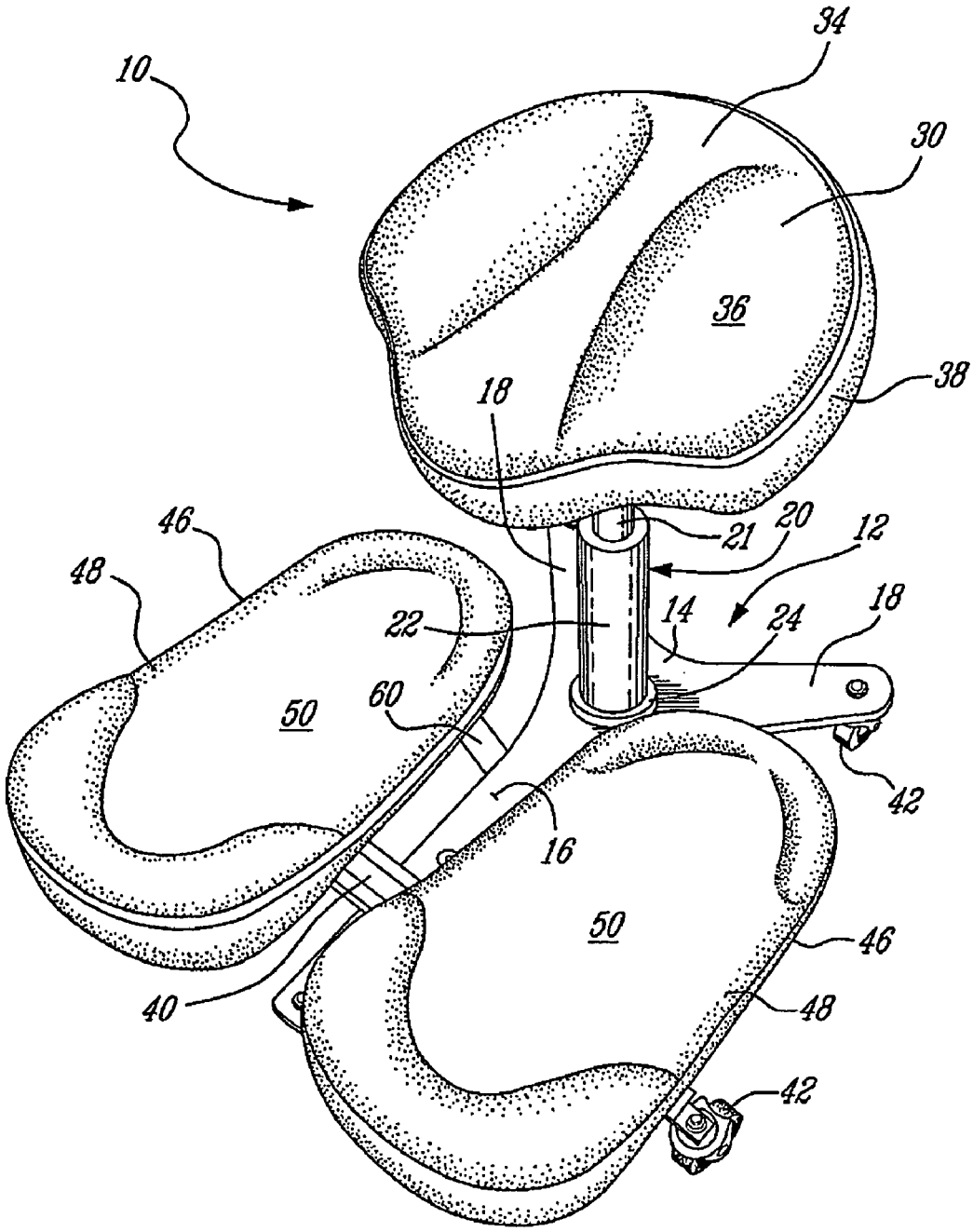
FIG. 1 is a top perspective view of an ergonomic seating assembly in accordance with an embodiment of the invention.

Referring now to the drawings, and more particularly to FIG. 1, there is shown a perspective view of an ergonomic seating assembly 10. The ergonomic seating assembly 10 has a frame 12 having a Y-shaped lower platform 14, disposed in a substantially horizontal plane, with a central stem 16 and two extending arms 18. For the purpose of the description, the central stem 16 will be described as extending at the front of the seating assembly 10 while the extending arms 18 will be described as projecting at the rear of the seating assembly 12.

A seat support tube 20, or post, having an upper section 21 and a sleeve section 22 is mounted to the Y-shape lower platform 14. A lower end 23 of the sleeve section 22 extends through an opening in the Y-shaped lower platform 14 (FIG. 2) at the junction of the central stem 16 and both extending arms 18. A frame seat socket 24 secures the seat support tube 20 to the Y-shaped lower platform 14. The seat support tube 20 can also be welded to the Y-shaped lower platform 14 or pivotally mounted to the Y-shaped lower platform 14 by any technique known to those skilled in the art. The seat support tube 20 can also be detacheably mounted to the Y-shaped lower platform 14 for facilitating the transportation of the seating assembly 10.

The upper section 21 is telescopically received into the sleeve section 22 for sliding movement with respect thereto between a raised and a lowered position. The height of the seat support tube 20 is adjustable by a pneumatic height adjustment mechanism, a lift or hydraulic cylinder assembly, but other mechanisms allowing a vertical adjustment can also be used. Such mechanisms are well known in the chair art and the details of construction of the same are not pertinent to the present invention. The mechanism can be controlled from a control lever 32. Manipulation of the control lever 32 by angular displacement of the same in various directions can release and thereafter lock the mechanism to permit the desired adjustment.

Figure 2:
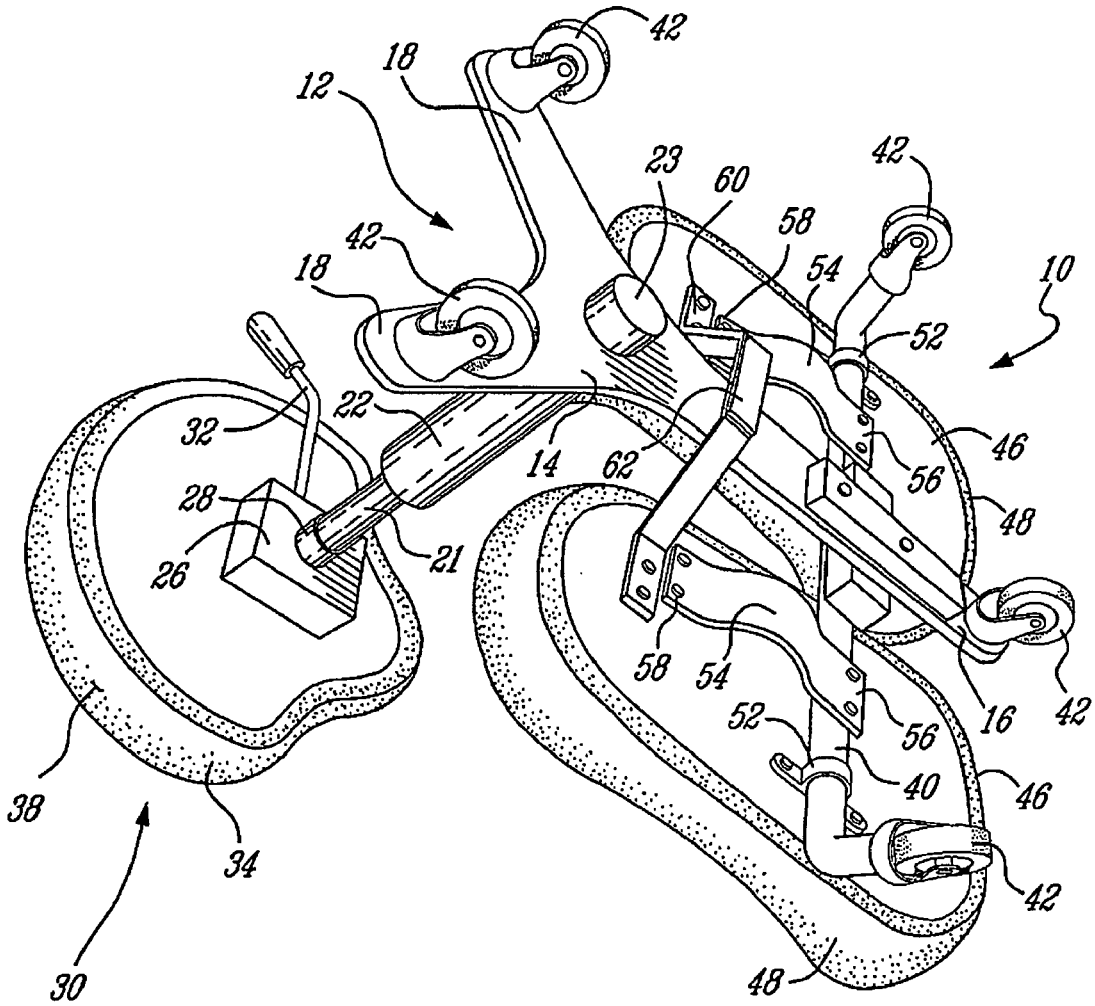
FIG. 2 is a bottom perspective view of the ergonomic seating assembly shown in FIG. 1.

Referring now to FIG. 2, there is shown that an abutment member 26 is rotatable mounted to an upper end 28 of the seat support tube 20. An upper support 30, or seat, is secured to the abutment member 26 and is preferably adjustably tiltable from a horizontal position as shown on FIGS. 3 and 5 to an inclined positioned, as shown in FIG. 4. In the preferred embodiment, the upper support 30 can be positioned between a horizontal plane and a rearwardly and frontwardly tilted planes. The abutment member 26 preferably includes the mechanism allowing the inclination or tilting of the upper support 30. Once the worker has ajusted the position of the upper support 30, this position can be locked with a control lever (not shown) operatively connected to the mechanism allowing the inclination of the upper support 30. The rotation of the upper support 30 relatively to the frame 12 can also be stopped with the same control lever or another one (not shown). One skilled in the art will appreciate the tilting and the rotation mechanisms can differ from the ones described hereinabove.

Referring back to FIG. 1, there is shown that the upper support 30 preferably includes a cushioned member 34, at least on its upper surface 36 and its periphery 38, to provide a comfortably seating assembly 10 to the worker. It can also have a particular shape to provide more comfort to the worker by providing more support where it is necessary. The upper support 30 has preferably a substantially circular shape to provide support to the buttocks as well as the torso as it will be described more in details later.

The frame 12 also includes a transversal support bar 40 extending perpendicularly to the central stem 16 of the Y-shaped lower platform 14 (FIG. 2). Casters 42, or wheels set in a swiveled frame, are secured at the ends of the central stem 16, the extending arms 18, and the transversal support bar 40 for providing support to the ergonomic seating assembly 10 on the floor and allowing the ergonomic seating assembly 10 to be easily displaced on the floor. The casters 42 are preferably positioned evenly about the frame 12 to evenly distribute the weight of the worker and stabilize the seating assembly 10.

Two lower supports 46, or knee pads or lower pads or knee supports, are mounted on the transversal support bar 40, parallel to the central stem 16, at a lower elevation than the upper support 30. Each lower support 46 is positioned on a respective side of the central stem 16. Each lower support 46 has a proximate end positioned proximate to the seat support tube 20 and a distal end opposite to the proximate end. The lower supports 46 preferably extends longitudinally to provide support along the worker's legs as it will be described more in details later. The lower supports 46 are preferably substantially flat, or leveled, longitudinally between the proximate and the distal ends. As for the upper support 30, the lower supports 46 prefereably include cushioned members 48, at least on their upper surface 50, to provide comfort to the worker. They can also have a particular shape to provide more comfort to the worker by providing more support where it is necessary as shown on FIG. 1.

Still referring to FIG. 2, it will be seen that the lower supports 46 can pivot relatively to the frame 12 since the lower supports 46 and the transversal support bar 40 are assembled with eye straps 52. The lower supports 46 can be pivoted between a horizontal plane (FIG. 4) and a rearwardly and frontwardly tilted planes (FIG. 5). For reinforcing the assembly of the lower supports 46 and the transversal support bar 40, two reinforcing bands 54 are used. The reinforcing bands 54 have a first end 56 secured to the transversal support bar 40 and a second end 58 secured to the lower supports 46. Even if fasteners are used to secure the reinforcing bands 54 and the eye straps 52 to the lower supports 46 and the transversal support bar 40 on FIG. 2, one skilled in the art that they can also be welded or adhesively mounted thereto. The reinforcing bands 54 are preferably biasing members to automatically pivot the lower supports 46 into the horizontal plane from the tilted plane once the weight has been removed thereon.

The lower supports 46 are also connected to one another with a rigid member 60 projecting under the central stem 16 of the Y-shaped lower platform 14. The lower supports 46 thus pivot in tandem. Since the rigid member 60 is positioned rearwardly of the lower supports 46, when the lower supports 46 pivot rearwardly, the central and lower section 62 of the rigid member 60 abuts the floor on which the ergonomic seating assembly 10 is disposed and prevents the caster rotation, as it will be described more in details later.

The frame 12 is preferably light and tubular. It can be made of an aluminum tubing though other metals and materials can be used. One skilled in the art will also appreciate that the frame 12 can differ from the configuration shown in the above described embodiment. For example, the platform 14 can be a solid plate-like frame.

Figure 6:
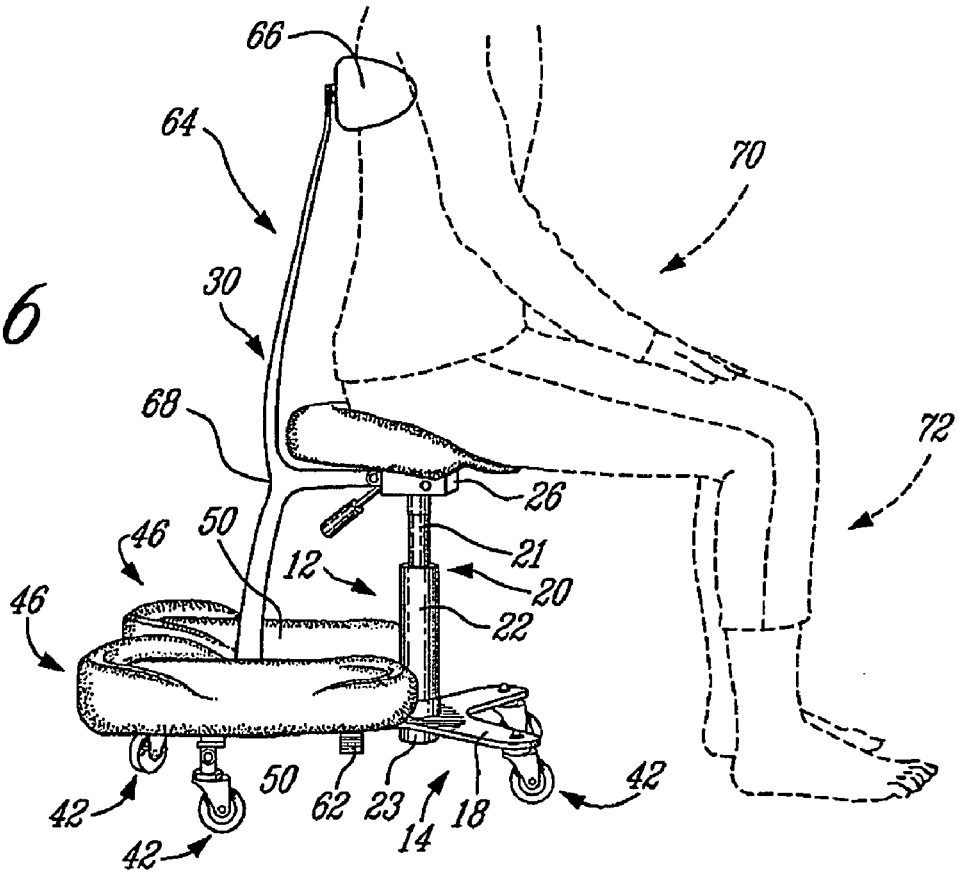
FIG. 6 is an elevation view of the ergonomic seating assembly shown in FIGS. 1 and 2, including a vertically oriented body support.
Figure 7:
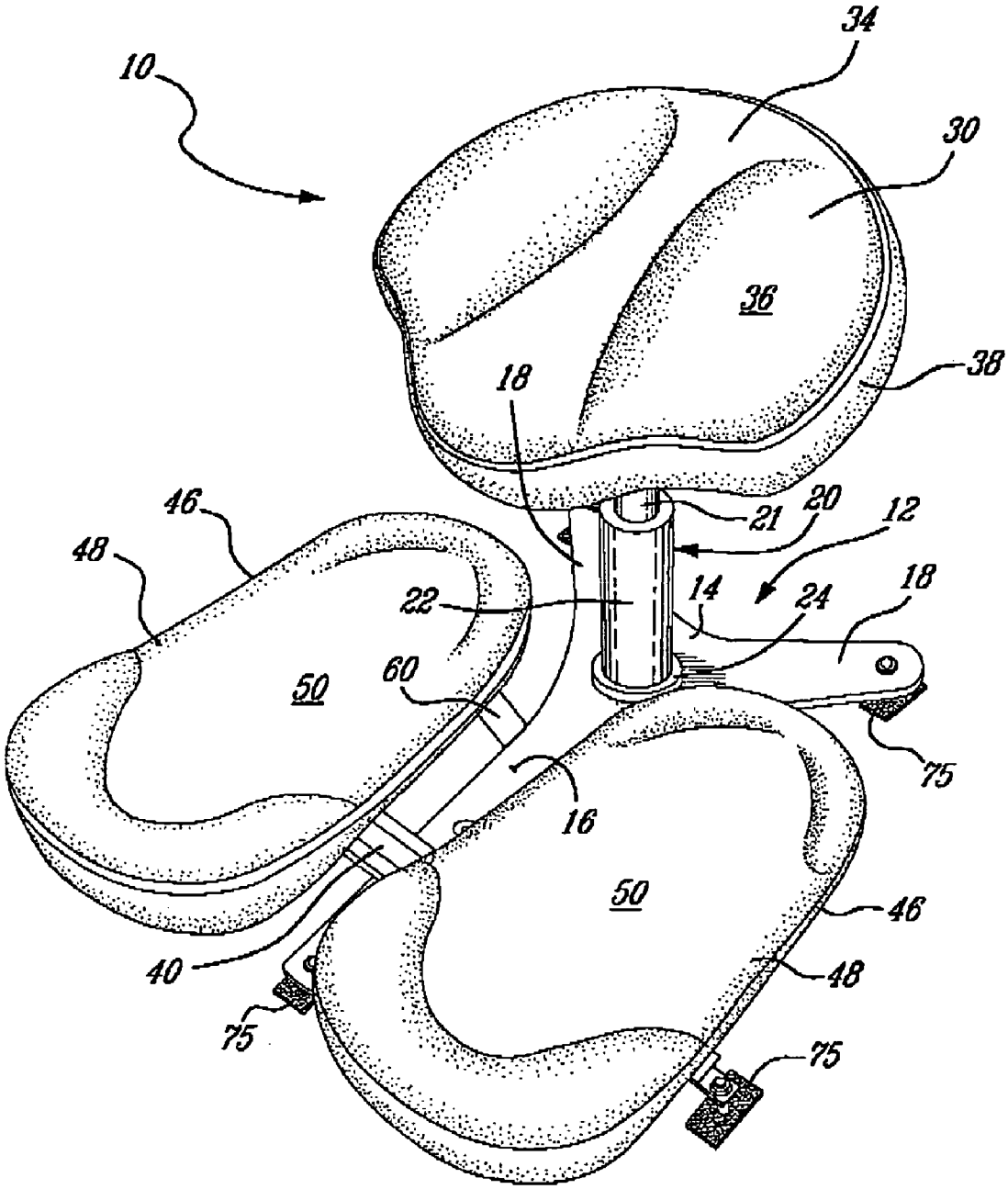
FIG. 7 is a top perspective view of the ergonomic seating assembly shown in FIG. 1, wherein the casters are replaced by another embodiment of support members.

Referring to FIG. 6, there is shown that the seating assembly 10 can include a vertically oriented body support 64 for providing support to either the worker's back or chest (not shown). The body support 64 includes a platform 66 having preferably a vertically arched shape for mating a back or a chest shape and a shaft 68 for mounting the body support 64 to the frame 12. In the embodiment shown on FIG. 3, the shaft 68 is mounted to the Y-shaped lower platform 14 and the abutment member 26. However, one skilled in the art will appreciate that it can be mounted only to one of the Y-shaped lower platform 14, the seat support tube 20 and the abutment member 26. The shaft 68 is preferably removably engaged to the frame 12. The inclination of the vertically oriented body support can be adjusted in accordance with the worker's needs. The platform 66 and/or the shaft 68 can be tilted forward or backward to provide a comfortable fits for both men's and women's back or chest. The platform 66 can also be mounted with height and distance from the shaft adjustments.

Figure 3:
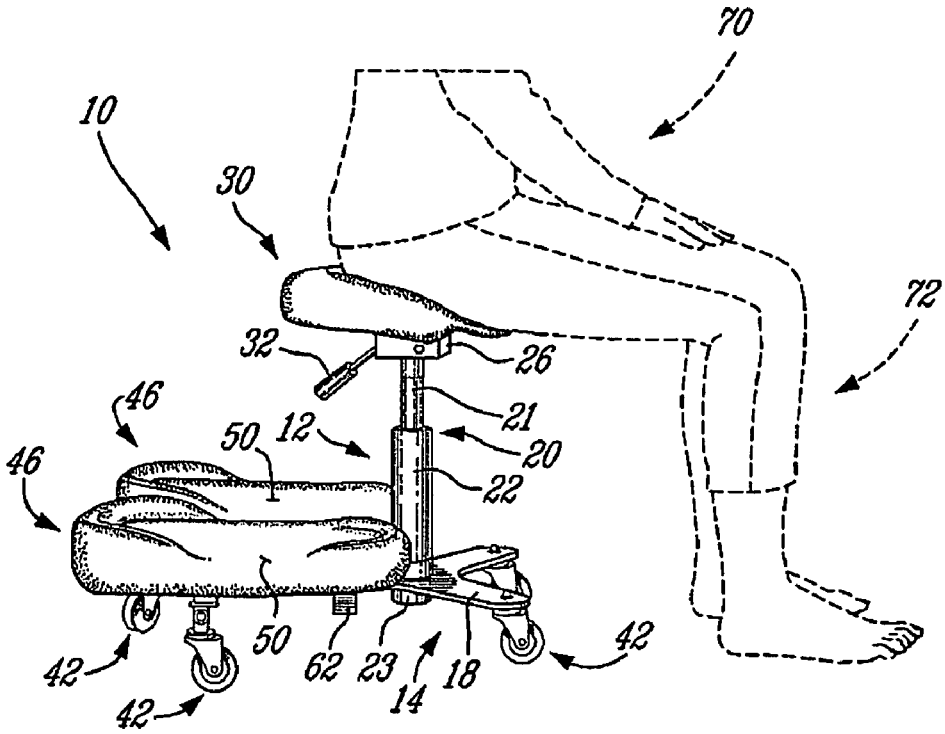
FIG. 3 is an elevation view of the ergonomic seating assembly shown in FIGS. 1 and 2, wherein a worker is seated in a first seating posture.
Figure 4:
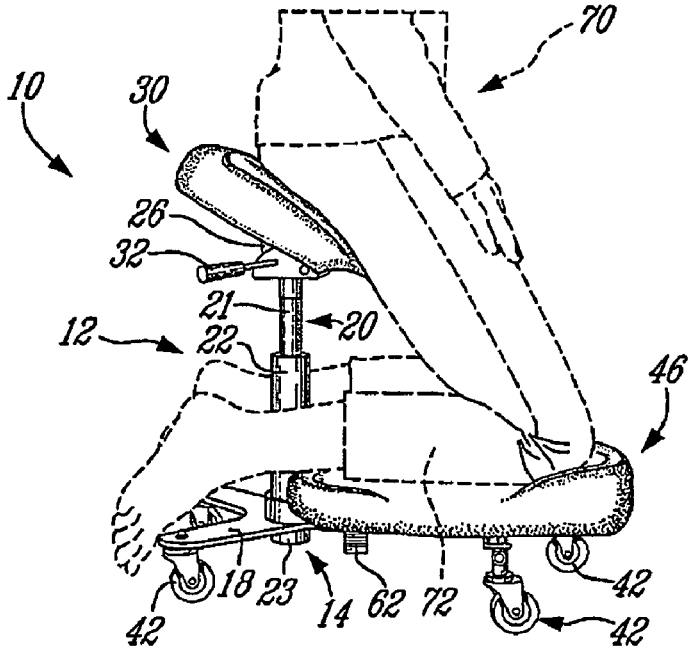
FIG. 4 is an elevation view of the ergonomic seating assembly shown in FIGS. 1 and 2, wherein a worker is seated in a second seating-kneeling posture.
Figure 5:
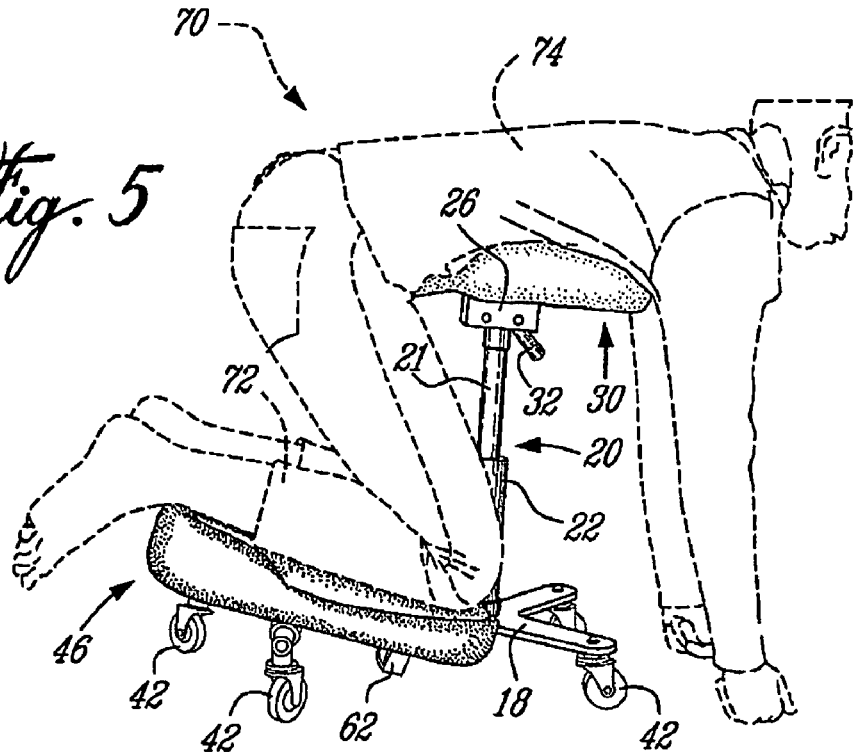
FIG. 5 is an elevation view of the ergonomic seating assembly of FIGS. 1 and 2, wherein a worker is seated in a third kneeling posture with a chest support.

Referring now to FIGS. 3, 4, and 5, it will be seen that the ergonomic seating assembly 10 allows at least three postures to a worker 70. Referring first to FIG. 3, there is shown a first posture, a seating position, wherein a worker 70 is facing rearwardly relatively to the frame 12. The worker 70 has his buttocks resting on the upper support 30 and is feet resting on the floor. The worker's back is in a straight position. As mentionned earlier, for more comfort, the height of the upper support 30 can be adjusted and the upper support 30 can be rotated, tilted and locked in a predetermined position. Moreover, the worker's can freely move the ergonomic seating assembly 10 over the floor. This first seating posture allows to the worker 70 to work at a height ranging between three and five feet. One skilled in the art will appreciate that it is not necessary to mount the body support 64 to the frame 12 in this first posture. Moreover, the body support 64 can be mounted to the frame 12 in a manner such that the worker 70 can abut his chest instead of his back on the platform 66 (not shown). The worker 70 can also face frontwardly relatively to the frame 12 in the first seating posture.

FIG. 4 shows the worker 70 in a second posture, a seating-kneeling position. The worker is facing frontwardly, the upper support 30 is tilted forward for more comfort, the legs 72 of the worker rest on a respective lower support 46, and his feet extend rearwardly. The worker's back is in a straight position. As for the first posture, the degree of inclination of the upper and lower supports 30, 46 can be modified in accordance with the worker's needs. This second seating-kneeling posture allows to the worker 70 to work at a height ranging between one and four feet. As for the first posture shown on FIG. 3, the body support 64 can be mounted to the frame 12 to support the worker in the second position. The platform 66 can be a support for either the worker's back, chest or forearms.

Referring now to FIG. 5, there is shown the worker 70 in a third posture, a kneeling position with a torso support. The worker is facing rearwardly, his torso 74 abuts the upper support 30, his legs 72 rest on a respective lower support 46, and his feet extend frontwardly. The lower supports 46 are inclined rearwardly and the central and lower section 62 of the rigid member 60 abuts the floor on which the ergonomic seating assembly 10 is disposed. It prevents the ergonomic seating assembly 10 to move freely over the floor while the worker is in the third posture. As for the first and the second postures (FIGS. 4 and 5), the degree of inclination of the upper and lower supports 30, 46 can be modified in accordance with the worker's needs and the height of the upper support 30 can also be modified. Abutting his torso 74 on the upper support 30 while being in this third posture allows to the worker 70 to freely use his both hands in his working task. This third kneeling posture allows to the worker 70 to work at a height ranging between zero and two feet.

The seating assembly 10 provides a combined buttocks, legs, and torso support with height and positional adjusting seat mechanisms.

The seating assembly 10 can include tool supports (not shown) which can be either securely or temporarily engaged to the frame 12 for providing an easily accessible storage space for the worker's tools while he is working. The position of the tool supports on the seating assembly 10 is preferably adjustable in accordance with the worker's needs.

The seating assembly 10 can have a breaking system which can differ from the one described hereinabove. The breaking system can be manually actuated by the worker in any posture. The breaking system can directly block the rotation movement of the casters 42.

The casters 42 can be replaced by riders or support members 75 covered with nylon or any other material allowing or preventing the displacement of the seating assembly 10 over the floor.

The shape of the platform 66 of the body support 64 can differ from the one shown on FIG. 3. For example, it can be designed to be used by the worker 70 as a forearm support during his working tasks.

The seating assembly 10 can also be designed in a manner such as to allow the displacement of the upper support 30 relatively to the frame 12. For example, the upper support can be displaceable over the abutment member 26 or the seat support tube 20 can be displaceable over the Y-shaped lower platform 14. The seat support tube 20 can be mounted to the Y-shaped lower platform 14 at a different location than at the junction of the central stem 16 and the extending arms 18. The upper support 30 can be directly mounted to the upper end 28 of the seat support tube 20. The abutment member 26 can differ from the one described hereinabove. For example, the abutment member 26 can be only a plate (not shown) mounted to the upper end 28 of the seat support tube 20 and juxtaposed to the lower surface 34 of the upper support 30.

As for the upper support 30, the lower supports 46 can be mounted to the frame 12 in a different manner from the one described hereinabove. For example, the lower supports 46 can be mounted to the frame 12 in a manner such that their position relatively to the frame 12 can be adjusted. The frame 12 can be designed to provide lower supports 46 that can be rotated, displaced transversally or longitudinally or adjustable in height. Therefore, the worker 70 can optimize his posture on the seating assembly 10 in accordance with its needs. The seating assembly 10 can also include a locking mechanism for blocking the position of the lower supports 46 relatively to the frame 12.

The seating assembly 10 can be provided in an easily retractable and foldable embodiment to enable easy transport.

The seating assembly 10 allows to the worker 70 to maintain a kneeling or seating working posture for an extended period of time, to easily move forward or rearward while keeping balance or equilibrium, a better comfort, an improved freedom of motion, and easy and quick working posture changes. It also creates a dynamism within the vertebral column to favor the nutritional exchanges of the intervertebral discs, reduces the fatigue by limiting muscular efforts from the worker; reduces the hip muscular tension; reduces the pressure sensation within worker's knees, ankles, and lumbar region (from mid to lower back region), and improves blood circulation.

The seating assembly 10 allows a better efficiency in working tasks requested to the workers, especially for the hands-free working postures between approximately zero and one and a half meter of height from the ground level.

The seating assembly 10 is an ergonomic and comfortable apparatus enabling different working postures, easily changeable from one to another such as: kneeling with a straight back, kneeling while bending forward, seating with a straight back, seating with a proper lumbar support, seating with a chest or forearm support, etc.

The seating assembly 10 enables leaning sideways without causing a lumbar spine torsion, thereby reducing back or related injuries.

The seating assembly 10 enables the worker 70 to be in a kneeling posture for longer periods by reducing the muscular effort requested. It also helps to prevent sudden unbalance to the worker 70.

The embodiments of the invention described above are intended to be exemplary only. For example, even if in the embodiment described hereinabove the seating assembly 10 has two lower supports 46, it is appreciated that it can include only one lower support 46 which shape can differ from the one illustrated. The seating assembly 10 can also include more or less casters 42. The scope of the invention is therefore intended to be limited solely by the scope of the appended claims.

What is claimed is:

1. A multi-posture seating assembly for a worker working proximate to the floor, the seating assembly comprising:

a frame adapted to rest at floor level, the frame having a forward end and a rearward end;

a plurality of support members secured at the forward and rearward ends of the frame and providing easy displacement of the seating assembly along a support surface;

an armrest and backrest-free upper support adjustably mounted to the frame, proximate to the rearward end, the upper support being at least forwardly and rearwardly tiltable relative to the floor; and a knee support extending longitudinally along the frame, frontwardly to the upper support and at a lower elevation than the upper support, the knee support being longitudinally substantially leveled for supporting the legs of the worker facing in one of the forward direction and the rearward direction relatively to the frame, the knee support pivoting between a substantially horizontal position and a rearwardly inclined position by applying pressure on a rearward end of the knee support, the displacement of the seating assembly along the floor being prevented when the knee support is in the rearwardly inclined position and allowed when the knee support is in the substantially horizontal position, the upper support and the knee support being configurable between a first configuration in which the upper support provides support to the torso of the worker facing rearwardly while the knees of the worker rest longitudinally on the knee support, and a second configuration in which the upper support is inclined relatively to the knee support to provide support to the buttocks of the worker facing frontwardly while the knees thereof rest longitudinally on the knee support in the substantially horizontal position.

2. A seating assembly as claimed in claim 1, wherein the knee support has a rearward end located under the upper support.

3. A seating assembly as claimed in claim 1, wherein support members are provided underneath the frame for allowing the same to be displaced over the floor.

4. A seating assembly as claimed in claim 3, wherein the support members comprise casters mounted to the frame.

5. A seating assembly as claimed in claim 1, wherein the upper support is rotatable about an axis extending in a plane generally perpendicular to the knee support.

6. A sealing assembly as claimed in claim 1, wherein the frame defines a substantially horizontal plane with an underside adapted to support the seating assembly on the floor and an upperside to which the knee pad is juxtaposed.

7. A seating assembly as claimed in claim 1, comprising at least one locking mechanism for locking one of the upper support and the knee support in a predetermined position.

8. A seating assembly as claimed in claim 1, comprising a braking mechanism operatively connected to the knee support and preventing the displacement of the seating assembly over the floor when the knee support is in the rearwardly inclined position.

9. A seating assembly as claimed in claim 8, wherein the braking mechanism comprises a braking portion of the knee support which is in braking engagement with the floor in the rearwardly inclined position, the braking portion being disengage from the floor when the knee support is in the substantially horizontal position.

10. A seating assembly as claimed in claim 1, wherein the knee support includes two lateral pads.

11. A seating assembly as claimed in claim 1, wherein the knee support is at least one of vertically and horizontally displaceable relatively to the frame.

12. A multi-posture body support device adapted for working proximate to the floor, the body support device comprising:

a frame extending at floor level, the frame having a front section, a rear section, and an extendible post in the rear section, the post being in a substantially perpendicular orientation relative to the floor;

a plurality of support members provided underneath the frame providing easy displacement of the frame over a support surface;

an upper support mounted to the post and forwardly tiltable; and a knee support mounted to the frame in front of the post and below the upper support, the knee support having a proximate end positioned proximate to the post and a distal end opposite to the proximate end, the knee support being substantially flat longitudinally between the proximate and distal ends for supporting longitudinally the legs of a worker facing one of the rear section and the front section relatively to the frame, the knee support being pivotable between a rearwardly inclined configuration for the rearwardly facing worker and a stable substantially horizontal configuration for the frontwardly facing worker; and a breaking mechanism to selectively prevent displacement of the frame over the floor when the knee support is in the rearwardly inclined configuration and allowing the displacement of the frame over the floor when the knee support is in the substantially horizontal configuration.

13. A multi-posture body support device as claimed in claim 12, wherein the rearwardly inclined configuration of the knee support is obtained by applying pressure on the proximate end towards the ground.

14. A multi-posture body support device as claimed in claim 12, wherein the support members comprise casters mounted to the frame.

15. A multi-posture body support device as claimed in claim 12, wherein the upper support is at least one of rotatable and inclinable about the post.

16. A multi-posture body support device as claimed in claim 12, wherein the proximate end of the knee support is under the upper support.

17. A multi-posture body support device as claimed in claim 12, comprising at least one locking mechanism for locking one of the upper support and the knee support in a predetermined position.

18. A multi-posture body support device as claimed in claim 12, wherein the breaking mechanism comprises a braking section of the knee support which is in braking engagement with the floor in the rearwardly inclined configuration, the braking section being spaced from the floor when the knee support is in the substantially horizontal configuration.

19. A multi-posture body support device as claimed in claim 12, wherein the knee support includes two lateral pads.

20. A multi-posture body support device as claimed in claim 12, wherein the knee support is at least one of vertically and horizontally displaceable relatively to the frame.

* * * * *